United States Patent [19]

Ott

[11] Patent Number: 4,701,942

[45] Date of Patent: Oct. 20, 1987

[54] INK JET FLUID FOR RADIOLOGY

[75] Inventor: Robert J. Ott, Gurnee, Ill.

[73] Assignee: American Technologies, Inc., Allendale, N.J.

[21] Appl. No.: 743,146

[22] Filed: Jun. 10, 1985

[51] Int. Cl.[4] ..... G21K 3/00

[52] U.S. Cl. ..... 378/156; 378/5; 378/158

[58] Field of Search ..... 378/156–159, 378/5, 18

[56] References Cited

U.S. PATENT DOCUMENTS

| | | | |
|---|---|---|---|
| 3,755,672 | 8/1973 | Edholm | 378/158 |
| 4,481,419 | 11/1984 | Persyk | 378/159 |
| 4,497,062 | 1/1985 | Mistretta et al. | 378/158 |

OTHER PUBLICATIONS

Erdhom & Jacobson—Primary X-Ray Dodging *Radiology* 99:694–696—Jun. 1971.

"A Digital Video Processor for Real Time Subtraction Imaging" by Krueger, Mistretta, Lancaster, Houk, Goodsitt, Shaw and Riederer Optical Engineering, vol. 17, No. 6, Nov.–Dec. 1978, pp. 652–657.

*Primary Examiner*—Janice A. Howell

[57] ABSTRACT

In radiology X-radiation from, an X-ray tube is directed toward a patient and received by an image means, which may be a film, to produce a visual image. The X-ray may be intended to detect a particular feature or area; however, the picture may be obscured by the unequal X-ray attenuation effect of the patient. That adverse effect is minimized by an attenuation mask which equalizes attenuation across the entire field. An individual mask is formed for each patient, on an almost real-time basis, by a first X-ray exposure which is analyzed to determine the extent and location of the patient's attenuation. The mask is produced, based upon that analysis, providing different attenuation at different areas, by depositing ink jet droplets, having suitable metal material, on an absorbent substrate.

20 Claims, 5 Drawing Figures

INK JET FLUID FOR RADIOLOGY

BACKGROUND OF THE INVENTION

The present invention relates to X-ray radiology and more particularly to the attenuation of X-rays by compressing filters to obtain an even X-ray field over the entire scan of the X-ray.

At the present time is is known that when certain portions of the patient are to be X-rayed, those portions may be seen in more detail if they have received a suitable X-ray contrast media. For example, a barium iodine solution may be used as the radiopaque media in the alimentary tract. In an X-ray film dense bone appears white and other materials appear in various shades of gray. However, even with skillful technique, the X-ray picture may be obscured due to unequal attenuation of the X-rays by the patient's own body. Generally, the absorption of the body varies greatly so that the contrast between portions of the body cannot be reproduced within the explosure latitude of the X-ray film. Certain portions of the patient's body are thicker than others and certain portions have bones and organs which differently affect the X-ray picture.

It would be desirable, in order to have an X-ray picture showing the greatest detail of the portion of the patient's body of interest, that the X-ray be evenly attenuated over the entire field (the entire scan) of the X-ray exposure. In one method of attenuation a solid aluminum three-dimensional filter(mask) is formed, see Erdhom & Jacobson, Primary X-Ray Dodging, *Radiology* 99:694–696, June 1971. The mask (filter) is positioned between the X-ray source and the patient, at the correct proportional distance.

OBJECTIVES AND FEATURES OF THE INVENTION

It is an objective of the present invention to provide, in radiology, an ink for an ink jet printer which will form an X-ray attenuation compensation mask for a relatively even distribution of the X-rays across the receiving field of an image receptor, the X-ray attenuation mask being formed by multiple passes of the ink jet printer head over an absorbent substrate.

It is a further objective of the present invention to provide such an ink that may be used in a high-speed ink jet printer without clogging or settling or causing excessive corrosion or wear.

It is a further objective of the present invention to provide such an ink that will, for each of its droplets, provide maximum X-ray attenuation, so that relatively fewer passes of the ink jet head over the substrate are required and the mask may be prepared in relatively less time, for example, in less than 30 seconds, to avoid inaccuracies which may occur if the patients move from their positions.

It is a further objective of the present invention to provide such an ink that will be relatively inexpensive, so that an individual mask for each patient may be used in mass screening radiology programs.

It is a further objective of the present invention to provide such an ink that will be retained in a substrate in a relatively thick layer and yet without spreading horizontally, to provide a mask having sharply delineated printed and unprinted areas.

It is a further objective of the present invention to provide such an ink that will be deposited on the substrate with an exact selected thickness so that each of the areas (pixels) of the mask may attenuate the X-rays over a broad range of attenuation and with a reasonable number of degrees (extent) of attenuation.

It is a feature of the present invention to provide a method in radiology of using an ink jet printer to prepare X-ray attenuation compensation masks. The masks are formed by depositing multi-droplets of ink on an absorbent substrate, such as thick blotting paper or a multi-cell honeycomb capillary structure. The radiology method includes the steps of determining the desired X-ray attenuation of each area (pixel) of the mask by taking an X-ray exposure and analyzing the X-ray intensity at each pixel of the image to provide intensity information. A computer is used to convert the intensity information into digital data in a digital feedback system. The digital data is used to control an ink jet printer. The printer deposits droplets on a substrate, preferably at a high rate. The number and location of the droplets is determined by the digital data. The X-ray attenuation mask comprises the substrate which is printed in selected areas (pixels) with the ink. Then the X-ray mask is positioned between the X-ray source and the receiving field (image) to attenuate the X-rays and produce an even intensity of the X-ray field. The entire procedure should be relatively fast, possibly during the suspension of the patient's respiration, i.e., holding one breath.

The ink consists of a dispersant of a finely divided powdered metal in a liquid carrier. The metal is selected from the group consisting of cesium, cadmium, calcium, lithium and barium.

In another embodiment the ink consists of a solute comprising a metal compound in a solution. The metal of the compound is selected from the group consisting of cesium, cadmium, calcium, lithium and barium.

It is a further feature of the invention that the ink jet printer has a multi-orifice head, to reduce the number of passes of the head over the substrate. Preferably the substrate is divided into a field of at least $32\times32$ pixels and may be $64\times64$ pixels.

In one embodiment the substrate is absorbent blotting paper, of at least $\frac{1}{8}$-inch in thickness and, in another embodiment, the substrate is a multi-cell honeycomb capillary tube structure.

BRIEF DESCRIPTION OF THE DRAWINGS

Other objections and features of the present invention will be apparent from the following detailed description which should be taken in conjunction with the accompanying drawings.

In the drawings:

FIG. 5 is a perspective view of a honeycomb capillary tube substrate.

DETAILED DESCRIPTION OF THE INVENTION

Figure 1:
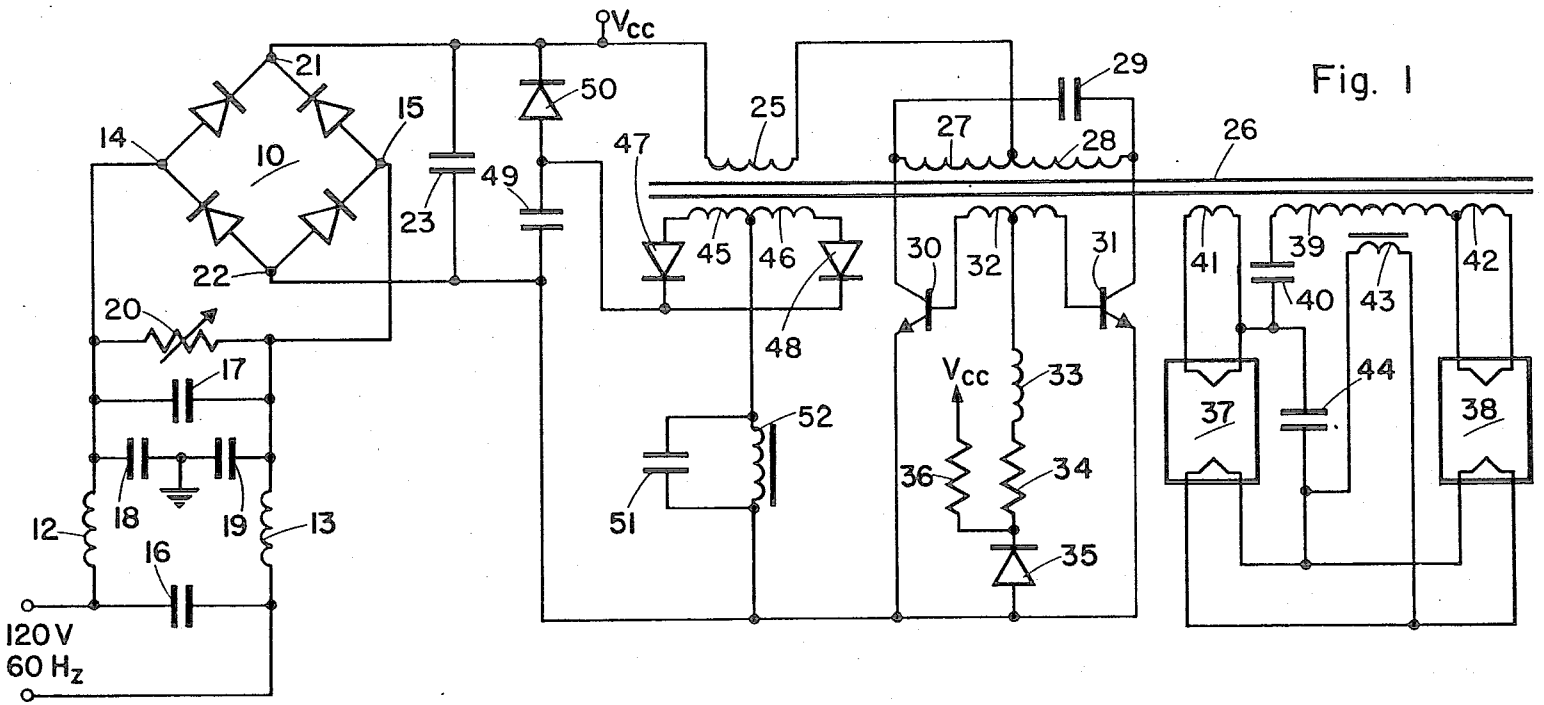
FIG. 1 is a block diagram of the system utilizing the present invention.

The diagnostic system which uses the method of the present invention is shown in FIG. 1. It includes an X-ray tube 10 (X-ray generator) which produces X-rays enveloped in an imaginary cone 11. The X-rays are received by the image producer 12. In conventional radiology the image producer 12 is an image intensifier and a film holder in which film is positioned. The film, which is explosed by the X-rays, is developed in chemical baths to produce a negative image X-ray film.

In the system of FIG. 1, the image producer 12 is an image intensifier and a transducer such as a video tube which is connected by line 13 to the digital video image processor 14 which produces a digital signal (digital data) corresponding to each area (pixel) of the video tube. The digital data is obtained by logarithmic transformation to enhance the image followed by A/D (analog/digital) conversion, i.e., digitization.

A suitable real time digital video image processor (VIP) system to convert the received X-rays into digital data for each pixel of a field is described in the article, "A Digital Video Processor For Real Time X-Ray Subtraction Imaging", by Krueger, Mistretta, Lancaster, Houk, Goodsitt, Shaw and Riederer, *Optical Engineering,* Vol. 17, No. 6, Nov.–Dec. 1978, pgs. 652–657. It includes a standard radiographic transducer, such as a cesium iodine image intensifier, and a Plumbion TV video tube. The video output of the tube is sent to a pre-procesor including a block level clamp, a logarithmic amplifier, and a buffer. Then the signals are converted to digital data by an 8-bit analog-to-digital converter (ADC) and stored in three memories.

Figure 2B:
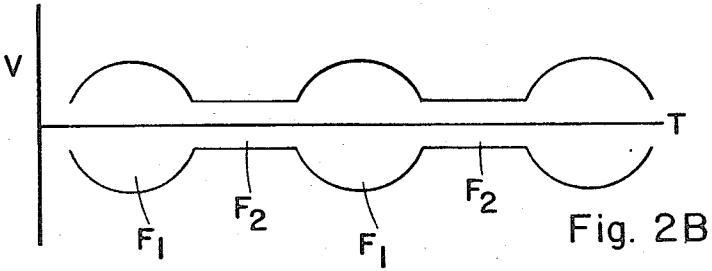
FIG. 2 is a cross-sectional view of one line scan of an X-ray image of a patient.
Figure 2A:
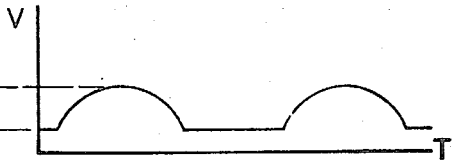
Figure 3:
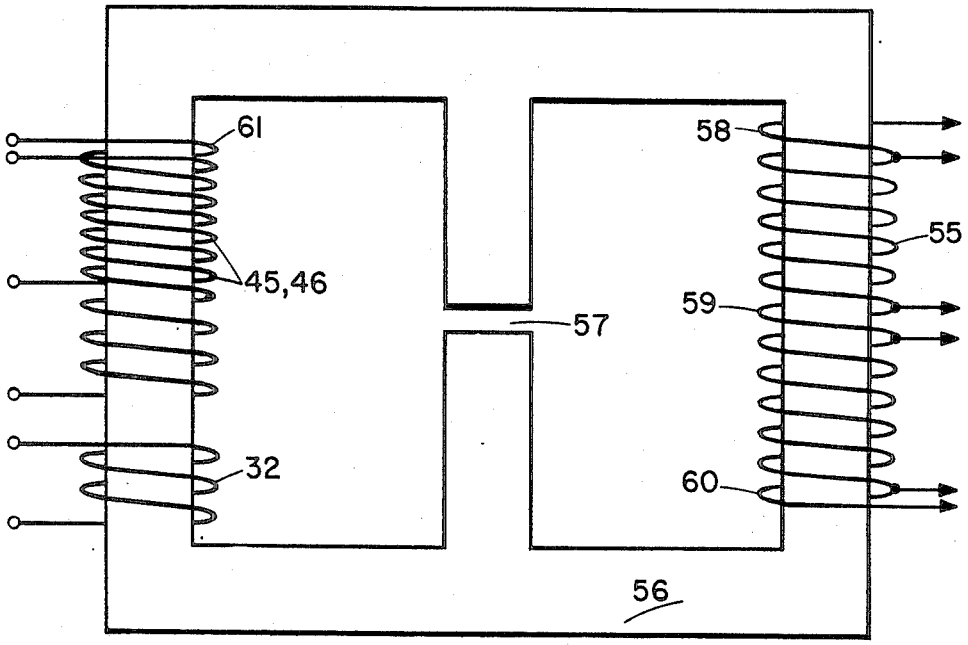
FIG. 3 is a view similar to FIG. 2 but with the attenuation mask of the present invention in position.

The patient 15 is positioned between the X-ray tube 10 and the image producer 12. The cross-sectional profile of the X-ray image, with the patient 15 in position, is illustrated in FIG. 2. The opposite ends 16,17 are more intense, as the X-rays pass only through air, and the center 18 is less intense as the X-rays are unevenly attenuated (reduced) by the patient's body, for example, by scattering which reduces contrast. FIG. 3 illustrates the desirable field at the image producer 12 in which the field 19 is even across over its full extent (height and width).

Figure 4:
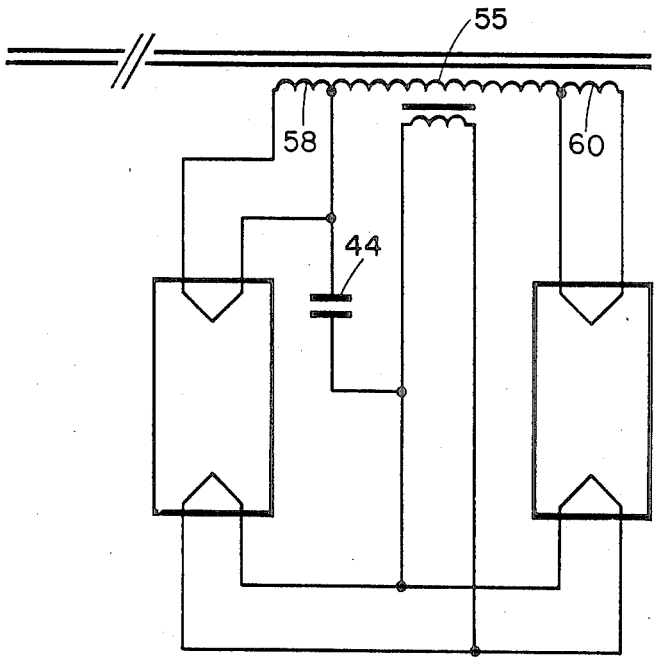
FIG. 4 is a view similar to FIG. 2, illustrating the effect of the attenuation mask without the presence of the patient.

To obtained the even field 19, a compensation mask attenuator 20 is positioned between the X-ray tube 10 and the patient 15. The mask attenuator 20, without the patient, would produce an image as illustrated in FIG. 4. When the patient 15 is in place, and the mask 20 is also in place, the X-rays pass through both the patient 15 and the mask 20 and are attenuated by both. If the mask is correctly made, it will, along with the patient's body, attenuate the X-rays to produce an even field at the image producer 12, such an even field being shown in FIG. 3.

The attenuation of the patient's body is not even; the skeleton, organs and thicker body portions will attenuate more than the thin body portions. The system of FIG. 1 computes the darkest pixel, representing the greatest attenuation of the patient's body without the mask, and produces a mask which was different attenuation values at its different areas (pixels) so that the attenuation of a pixel of the mask, plus the attenuation of the patient's body in the area corresponding to that pixel, will have a uniform value.

The digital image processor 14 is connected to computer 21. The computer 21 controls the ink jet printer 22 which prints on an absorbent substrate which is in ribbon form. The ribbon, for example, one inch in width, is unreeled from source 23 and reeled up by take-up reel 24.

In one type of ink jet printing a fluid ink is forced, under pressure, through one or more very small orifices in an orifice block which contains a piezoelectric crystal vibrating at high frequency (50–100,000 vibrations per second), causing the ink passing through the orifice to be broken into minute droplets equal in number to the crystal vibrations. The minute droplets pass through a charging area where individual droplets receive an electrical charge in response to a video signal. The amplitude of the charge depends on the amplitude of the video signal. The droplets then pass through an electrical field of fixed intensity, causing a varied deflection of the individual droplets (dependent on the intensity of the charge associated with the droplet). The deflected drops are allowed to infringe on the base substrate which is to receive the decorative or informative printed indicia.

The ink deposited by the ink jet printer contains a metal which attenuates the X-rays. The ink may be used with an ink-on-demand type printer having a single ink jet head, which, however, operates at a slow rate, for example, 2.5 K (2500 droplets per second). Preferably, a multi-head ink jet array is used. The multi-head ink jet array is operated at a high rate for depositing droplets, the rate being in the range 50–100 K Hz (50,000–100,000 droplets per second) and, for example, is 66 K Hz. An ink jet array, available from Mead, Dayton, Ohio, has 2700 ink jets in a one-inch array. It deposits $2700 \times 66{,}000$ or 17,820,000 droplets per second in one pass of the array head.

The droplets are deposited onto an absorbent substrate The substrate may absorb and retain many layers of droplets, forming a vertical pool, without excessive lateral spreading. In one embodiment the substrate is thick cellulose blotting paper, over $\frac{1}{8}''$ thick and preferably 3/16" thick. In an other embodiment, shown in FIG. 5, the substrate is a honeycomb structure formed in joined capillary tubes with the alignment of the tube axis being perpendicular to the plane of the substrate. The ink will be deposited in the tubes and the attenuation will depend upon how many droplets are deposited in each tube. Preferably there are sufficient droplets to form a "gray scale" of at least 30 degrees of attenuation, from zero to 100%, each degree being 3.33% of the scale. The honeycomb is flexible and may be re-used by cleaning out the ink.

The substrate is small, for example, an inch square (2.54 cm) and is formed into imaginary discrete areas (pixels), preferably a grid of equal-sized squares. There are at least $32 \times 32 =$ pixels, i.e., each pixel is 1/32-inch square (0.079 cm); however, the substrate may be a $64 \times 64$ grid.

Preferably the ink is a dispersant liquid system in which finely powdered metal is held suspended in a carrier fluid, for example, the metal may be 17%, by weight, of the liquid system. The metals are preferably selected from the group consisting of lead, barium, cadmium, calcium, cesium and lithium. Preferably the metal particles are less than 3 microns in diameter. Each droplet of the dispersant, i.e., a single layer, provides a 13% attenation of the X-rays. An organic carrier, such as methyl ethyl ketone, is used to transport the metal particles. The ink does not dry, or clog the ink jet device, and stays liquid for 2–4 weeks.

Alternatively, the ink is of neutral Ph and is a solvent system in which the solute is a metal compound. The metal is selected from the group of barium, cadmium, calcium, cesium and lithium.

The solvent system does not give as much attenuation per droplet as the dispersant system; for example, each droplet attenuates 1% to 2% of the X-rays. To abtain, for example, a 40% attenuation, it is necessary, with a 1% attenuation per drop system, to deposit 40 layers on each pixel. Suitable metal compounds (solute) and their solvents are shown below in the order of their attenuation, with the highest listed first.

| Compound | Solvent | Single Layer Thickness (μm) | No. of Layers For Dynamic Range = 20 |
|---|---|---|---|
| barium bromide | hot water | .85 | 636 |
| barium iodide | cold water | .92 | 364 |
| cesium fluoride | cold water | 1.69 | 281 |
| cesium iodide | hot water | .94 | 416 |
| cadmium iodide | MeOH | .95 | 356 |
| calcium iodide | hot water | 1.86 | 282 |
| cobalt(ii) iodide | hot water | 1.53 | 249 |
| lithium iodide | MeOH | 1.78 | 308 |

In general, solvent system jet inks contain a dye, a solvent blend, a resinous component and an electrolyte in an amount effective to achieve desired drop deflection characteristics. The ink components must be in carefully balanced proportion to achieve successful operation. The effective amount of electrolyte will vary, depending on the original resisitivity of the ink and on the resistivity desired.

What is claimed is:

1. The method, in radiology, of using a printer to prepare an individual X-ray attenuation compensation mask for each patient by placing ink on a substrate, comprising the steps of:

determining the desired X-ray attenuation of each area of the mask by operating an X-ray source to produce a first X-ray exposure of the patient, analyzing the X-ray intensity at each location of the receiving field to provide intensity information, using computer means to convert the intensity information into digital data corresponding thereto, and using the digital data to control a printer to print ink on a substrate with the location of the ink being determined by the said digital data to provide an X-ray attenuation mask which is selectly printed with the ink in certain areas, positioning the X-ray attenuation mask between the X-ray source and receiving field to attenuate the X-rays by the mask and produce an even intensity of the X-rays at the receiving field and taking a second X-ray exposure of the patient;

characterized in that the printer is an ink jet printer which deposits ink jet droplets on said substrate, the jet printer deposits a plurality of droplets on certain areas of the substrate with the number of droplets at each area being controlled by said digital data, said substrate is an ink absorbent sheet and said ink jet droplets consist of a dispersant of a finely powered metal in a liquid carrier.

2. The method of using an ink jet printer as in claim 1 wherein the powdered metal is selected from the group consisting of lead, barium, cesium, calcium, cadmium, cobalt and lithium.

3. The method of using an ink jet printer as in claim 1 wherein said printer uses a multi-orifice head to reduce the required number of passes of the head over the substrate.

4. The method of using an ink jet printer as in claim 1 wherein said substrate is divided into a field of at least 32×32 pixels.

5. The method of using an ink jet printer as in claim 1 wherein said substrate is absorbent blotting paper of at least ⅛-inch in thickness.

6. The method of using an ink jet printer as in claim 1 wherein said substrate is a multi-cell honeycomb capillary tube structure whose tubes are perpendicular to the plane of the substrate.

7. The method of using an ink jet printer as in claim 1 wherein the printer has an ink jet head which makes at least 20 passes over the substrate to deposit at least 20 droplets in selected areas.

8. The method of using an ink jet printer as in claim 1 wherein the mask is produced in less than 40 seconds and the entire X-ray procedure measured from the first exposure to the second exposure occurs in less than one minute.

9. The method of using an ink jet printer as in claim 1 wherein the printer operates at a high rate of over 50,000 Hertz to produce the mask within 40 seconds.

10. The method of using an ink jet printer as in claim 1 wherein the attenuation of a single layer of said ink on said substrate is at least 10%.

11. The method, in radiology, of using an ink printer to prepare an individual X-ray attenuation compensation mask for each patient by placing ink on a substrate, comprising the steps of:

determining the desired X-ray attenuation of each area of the mask by operating an X-ray source to produce a first X-ray exposure of the patient, analyzing the X-ray intensity at each location of the receiving field to provide intensity information, using computer means to convert the intensity information into digital data corresponding thereto, and using the digital data to control a printer to print on a substrate with the location of the ink being determined by the said digital data to provide an X-ray attenuation mask which is selectly printed with the ink in certain areas, positioning the X-ray attenuation mask between the X-ray source and the receiving field to attenuate the X-rays by the mask and produce an even intensity of the X-rays at the receiving field and taking a second X-ray exposure of the patient;

characterized in that the printer is an ink jet printer which deposits droplets of ink on said substrate, the jet printer deposits a plurality of droplets at each area being controlled by said digital data, said substrate is an ink absorbent sheet and the ink consists of a solution of a metallic compound as the solute.

12. The method of using an ink jet printer as in claim 11 wherein the metallic compound is selected from the group consisting of calcium, cesium, cadmium, cobalt, lithium and barium, and the solvent is an organic solvent.

13. The method of using an ink jet printer as in claim 11 wherein said printer uses a multi-orifice head to reduce the required number of passes of the head over the substrate.

14. The method of using an ink jet printer as in claim 11 wherein said substrate is divided into a field of at least 32×32 pixels.

15. The method of using an ink jet printer as in claim 11 wherein said substrate is absorbent blotting paper of at least ⅛-inch in thickness.

16. The method of using an ink jet printer as in claim 11 wherein said substrate is a multi-cell honeycomb capillary tube structure whose tubes are perpendicular to the plane of the substrate.

17. The method of using an ink jet printer as in claim 11 wherein the printer has an ink jet head which makes at least 20 passes over the substrate to deposit at least 20 droplets in selected areas.

18. The method of using an ink jet printer as in claim 11 wherein the mask is produced in less than 40 seconds and the entire X-ray procedure measured from the first exposure to the second exposure occurs in less than one minute.

19. The method of using an ink jet printer as in claim 11 wherein the printer operates at a high rate of over 50,000 Hertz to produce the mask within 40 seconds.

20. The method of using an ink jet printer as in claim 11 wherein the attenuation of a single layer of said ink on said substrate is at least 1%.

* * * * *